US005171594A

United States Patent [19]

Babbitt

[11] Patent Number: 5,171,594

[45] Date of Patent: Dec. 15, 1992

[54] MICROWAVE FOOD PACKAGE WITH PRINTED-ON SUSCEPTOR

[75] Inventor: R. Jefferson Babbitt, New Hope, Pa.

[73] Assignee: Union Camp Corporation, Wayne, N.J.

[21] Appl. No.: 676,901

[22] Filed: Mar. 27, 1991

[51] Int. Cl.[5] ..... B65D 85/00

[52] U.S. Cl. ..... 426/107; 219/10.55 E; 426/111; 426/234

[58] Field of Search ..... 426/107, 243, 234, 241, 426/111; 219/10.55 E

[56] References Cited

U.S. PATENT DOCUMENTS

| | | | |
|---|---|---|---|
| 4,676,857 | 6/1987 | Scharr et al. | 426/107 |
| 4,866,232 | 9/1989 | Stone | 426/243 |
| 4,883,936 | 11/1989 | Maynard et al. | 426/107 |
| 4,904,488 | 2/1990 | LaBaw et al. | 426/107 |
| 4,914,266 | 4/1990 | Parks et al. | 426/107 |
| 4,943,456 | 7/1990 | Pollart et al. | 426/107 |
| 4,959,516 | 9/1990 | Tighe et al. | 219/10.55 E |
| 4,970,358 | 11/1990 | Brandberg et al. | 426/107 |

FOREIGN PATENT DOCUMENTS 0347193 12/1989 European Pat. Off. ..... 219/10.55 E

*Primary Examiner*—Donald E. Czaja
*Assistant Examiner*—Jean L. Aberle
*Attorney, Agent, or Firm*—William K. Wissin

[57] ABSTRACT

A gusseted microwave food package, such as a microwave popcorn bag, is provided, having a printed-on susceptor with reduced microwave activity under the gussets of the package. The novel susceptor substantially prevents charring of the package during microwave heating at portions of the package under the gussets. Preferably, the susceptor is printed on in a plurality of small patterns so as to prevent the undesirable edge heating effects encountered with large patterns. The printed-on susceptor of this invention may be formed from ink compositions which are graphite or metal based, and are preferably printed on a surface which does not directly contact the food contained in the package. The technique of the invention may be employed with numerous different susceptor patterns so long as the print coverage, and thus the microwave activity, under the gussets is reduced to prevent charring or burning.

34 Claims, 9 Drawing Sheets

MICROWAVE FOOD PACKAGE WITH PRINTED-ON SUSCEPTOR

FIELD OF THE INVENTION

The present invention relates to a microwave package for holding food which is to be heated in a microwave oven, and more particularly, to a gusseted microwave food package with a printed-on susceptor.

DESCRIPTION OF THE PRIOR ART

Numerous microwave packages have been proposed for holding food products during heating in a microwave oven. It is known to include in the microwave packages devices, hereinafter referred to as susceptors, which generate auxiliary heat upon exposure to microwave energy. Prior art susceptors come in many shapes and sizes and typically are an integral part of the microwave food packages. For example, as described by Stone in U.S. Pat. No. 4,866,232, susceptors may be formed from metallized ink which consists of metal particles suspended in a binder, where the metallized ink is deposited on the surface area of the container at the location where enhanced heat is desired. Such enhanced heat is typically desired at locations where the food product is to be browned or crisped, as taught by Maynard et al. in U.S. Pat. No. 4,883,936. Parks et al., in U.S. Pat. No. 4,914,266, discloses different microwave susceptors which use a conductive carbon material such as graphite or carbon black as the microwave active susceptor material. The materials are formed into an ink and printed by a process such as gravure onto a paperboard packaging material in the areas where the food is to be browned. The resulting susceptor is then overcoated with a coating so that the food may be placed directly on the susceptor. Harrison in U.S. Pat. No. 4,917,748 discloses a similar susceptor which may be formed from any combination of metallic particles such as aluminum, copper, gold, tin and zinc, metallic oxide particles such as barium dodecairon nonadecaoxide, di-iron nickel tetra-oxide, manganese di-iron oxide and zinc di-iron oxide, or carbon particles such as natural and synthetic graphite particles and carbon black particles. The microwave active layer is then overcoated by a protective layer, preferably a heat curable varnish, to separate the microwave active particles from the food. As with the susceptors of Stone and Parks et al., the food may then be placed directly on the susceptor for browning or crisping.

It has been discovered that susceptors of the type described in the aforementioned prior art patents may cause burning or scorching of the substrate on which they are applied during microwave heating. Susceptors formed from graphite may also cause runaway heating of the substrate. Attempts have been reported in the prior art to design susceptors so as to limit overheating of the substrate using different thermal compensation techniques. For example, Brandberg et al. in U.S. Pat. No. 4,970,358 suggests using electrically non-conductive thermo-compensating particles in the susceptor for dissipating or compensating in part for the heat produced by the microwave active particles. Pollart et al. in U.S. Pat. No. 4,943,456 and Hartman et al. in U.S. Pat. No. 4,982,064 suggest including moderating materials such as clay and dielectric organic solid binders to prevent overheating. However, burning and charring of microwave food packages still remains a problem because of the high temperatures, and more particularly, the large temperature differentials which occur at portions of food packages during microwave heating.

Gusseted microwave packages such as microwave popcorn bags with susceptors are taught by Watkins et al. in U.S. Pat. No. 4,735,513 and are also disclosed in the aforementioned patents to Hartman et al. and Pollart et al. Due to the nature of the desired heating in such packages, namely that the temperature at the susceptor must be quickly ramped to a high temperature to rapidly heat the popcorn and oil to cause the desired popping, such packages have been found to have substantial problems with burning and charring. Susceptor materials of the types described in the aforementioned patents have not been successful at preventing burning and charring, particularly of gusseted packages such as a microwave popcorn bag.

Burning of gusseted packages has been a particular problem because of the substantial temperatures which develop under the gussets during heating. Prior art microwave packages containing susceptors have not successfully addressed the burning and charring problems, and more particularly, no known prior art gusseted microwave packages have been designed to compensate for the excessive heating which typically occurs under the gussets.

Accordingly, it is desired to provide a gusseted microwave food package having a susceptor which does not cause burning and charring of the package during microwave heating.

SUMMARY OF THE INVENTION

It has been discovered that the aforementioned problems with charring of gusseted packages can be overcome by providing a printed-on susceptor having a patterned susceptor which is broken up into sub-patterns so as to eliminate the edge heating effect and by also adjusting the microwave activity of the sub-patterns such that the microwave activity of the portion of the susceptor under the gussets is lower than in the center of the food package which is not under the gussets. In particular, it has been discovered that by reducing the microwave activity of the portion of the susceptor underneath the gussets of a microwave food package, such as a microwave popcorn bag, runaway heating can be effectively prevented. The term "microwave activity" as used herein refers to the relative response of the printed-on susceptor to produce heat on exposure to microwave energy. With the printed-on susceptor, this is most readily controlled by "print coverage" which, as used herein, means either the area of the substrate covered by the susceptor ink, the thickness (density) of the susceptor ink in a given area, or the concentration of microwave active particles in the given area. Preferably, the susceptor is formed from a coating of microwave active particles, such as graphite or metal, which are applied to a substrate in a printing operation. Such a technique is preferred since it is rather easy and inexpensive.

DETAILED DESCRIPTION OF THE INVENTION

Figure 1A:
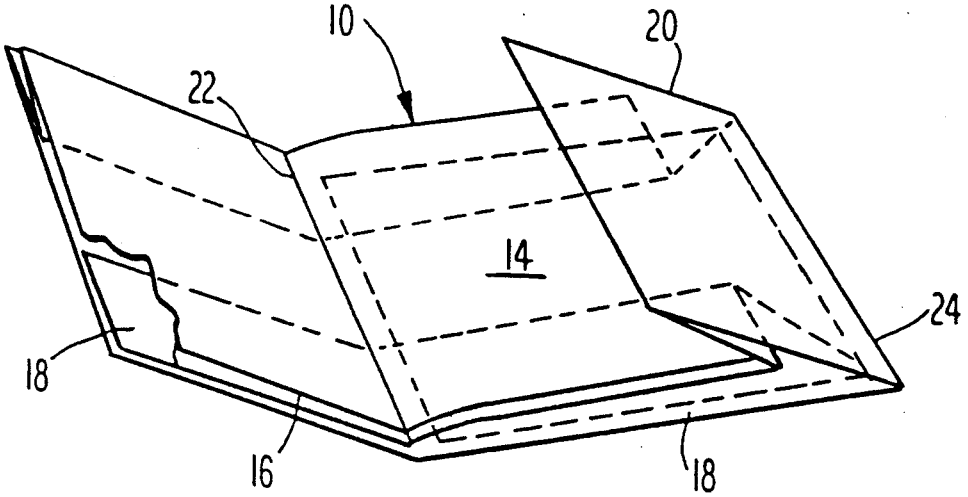
FIGS. 1A and 1B are perspective views of opposite sides of a non-expanded self-opening style bag having the printed-on susceptor of this invention.

In particular, the present invention relates to a microwave food package with gussets on opposite sides thereof and an opening for the introduction of food into the package. Preferably, such a food package, if it is to contain oils or fats, is comprised of a greaseproof inner substrate for holding the food, including the oil or fats, an outer substrate surrounding and adhesively attached to the inner substrate, and a printed-on susceptor comprising a coating of a microwave reactive composition printed on either an inner surface of the outer substrate or an outer surface of the inner substrate, in a pattern having a first microwave activity in a center portion of the microwave food package and a second microwave activity, less than the first microwave activity, under the gussets. The first and second microwave activities are selected to provide a substantially uniform temperature across the entire susceptor pattern during microwave heating of the food. The resulting susceptor substantially eliminates charring of the inner and outer substrates under the gussets during heating of the food. In accordance with a preferred embodiment of the invention, the food is popcorn and oil, primarily located in the center portion of the package during initial heating. In such a case, the inner and outer substrates may be formed into a bag, such as a self-opening style or a pillow style microwave popcorn bag, for holding the popped popcorn and oil.

In accordance with the invention, the printed-on susceptor is comprised of sub-patterns in a spaced relationship adapted to moderate the heat developed on exposure to microwave energy across the pattern so as to substantially prevent charring of the inner and outer substrates during microwave heating. The microwave activity may be varied by adjusting the surface area coverage, the thickness of the print, the concentration of the microwave interactive particles in the ink, and by a combination of these means. Preferably, the sub-patterns in the center portion are determined by the first microwave activity, while sub-patterns under the gussets similarly are determined by the second microwave activity. Various types of sub-patterns, such as squares, rectangles, circles, triangles, and the like, may be used in accordance with this invention.

A first embodiment of this invention is characterized in that in the first microwave active area, in the center portion, the surface area coverage is in a range of approximately 60% to 90% of the surface area, while in the second microwave active area the surface area coverage is less than the first coverage and is in a range of approximately 20% to 80% of the surface area of a portion of the microwave food package under the gussets by the pattern. In preferred embodiments, the second print coverage is in a range of approximately 40% to 60% of the surface area of the portion of the microwave food package under the gussets covered by the pattern. It is preferable that the difference between the microwave activity of the first area and the second area as measured by surface area coverage be at least about ten percent (10%) and less than about forty percent (40%). Similar percentages apply for microwave activity determined by the thickness of the print or the concentration of the microwave interactive particles in the ink.

Although the susceptor may be made of many different types of microwave reactive materials, the microwave reactive composition material preferably is graphite based inks, although either metal based inks or an ink having carbon black containing particles may be used.

This invention also includes a method of manufacturing a microwave food package with gussets on opposite sides thereof and an opening for the introduction of food to be heated in a microwave oven. Such a method in accordance with the invention preferably comprises the steps of:

providing a greaseproof inner substrate and an outer substrate;

printing onto either the inner surface of the outer substrate or the outer surface of the inner substrate a susceptor comprising a coating of a microwave reactive composition in a pattern having a first microwave activity in a center portion of the microwave food package and a second microwave activity, less than the first microwave activity, under the gussets, the first and second microwave activities being selected so as to substantially prevent charring of the inner and outer substrates under the gussets during heating of the food, while still allowing the microwave heating;

laminating the inner surface of the outer substrate to the outer surface of the inner substrate, with the susceptor sandwiched therebetween; and shaping the laminated substrates into the microwave food package with the gussets and the opening for the introduction of food.

The shaping step may be performed by either transferring the laminated substrates to a bag-making machine or transferring the laminated substrates to a form, fill and seal packaging machine. In a preferred embodiment, the microwave food package is filled with popcorn.

Figure 1B:
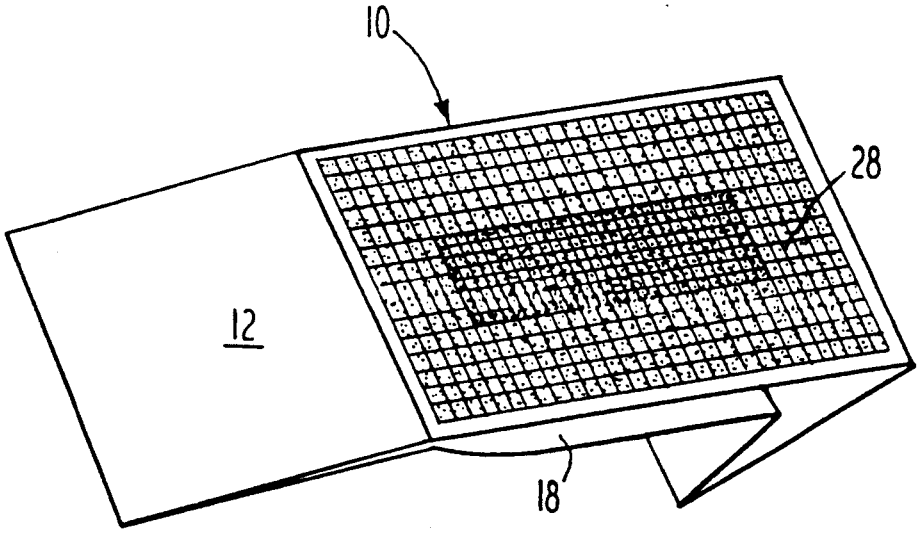

FIGS. 1A and 1B illustrate a self-opening style microwave food package 10, such as a microwave popcorn bag, comprising a front side 12 and a back portion 14 with a sealed side seam 16. A top end portion of the front side 12 of the bag 10 may be sealed to the backside 14 in the bag in accordance with known techniques. The bag is provided with gusseted side panels 18 which extend from the top of the bag to a conventional bottom section 20. Gussets 18 allow the bag 10 to expand during heating. When used as a microwave popcorn bag, the majority of the popcorn and oil occupy a mid-section of the bag between fold lines 22 and 24. A printed-on susceptor 28 formed in accordance with this invention is further provided at the central area of the package, as illustrated by printing the susceptor 28 in accordance with the techniques to be described in more detail below.

Figure 2A:
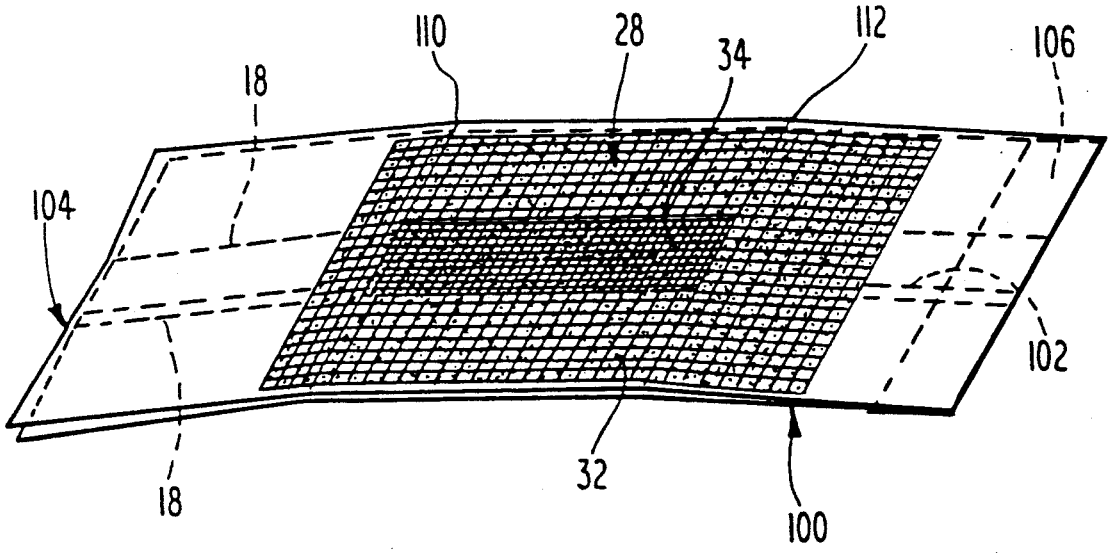
FIG. 2A is a perspective view of the bottom side of a non-expanded, unfilled, gusseted pillow style bag having the printed on susceptor of this invention.
Figure 2B:
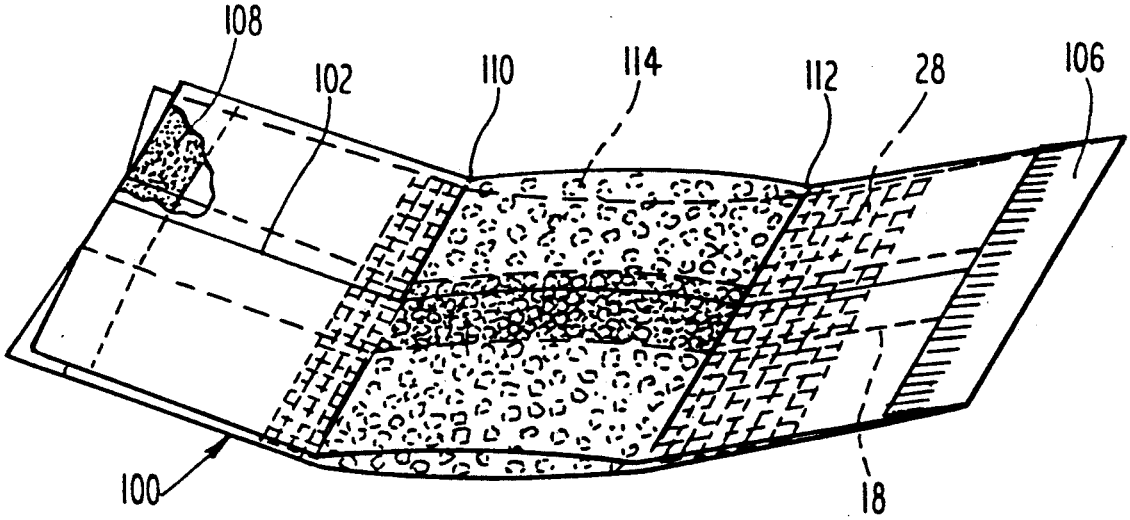
FIG. 2B is a perspective view of the top side of a non-expanded, gusseted, pillow style bag as illustrated in FIG. 2A, which is shown filled with popcorn and sealed.

FIGS. 2A and 2B illustrate a further embodiment of a microwave food container which is a pillow style bag 100 having a printed-on susceptor 28. The pillow style bag 100 of FIG. 2A has a sealed side seam 102, an opening 104 for accepting food product such as popcorn and oil, and a sealed bottom seam 106. The susceptor 28 comprises a first microwave active area 34 which is bordered by gussets 18 and fold lines 110 and 112; and a second microwave active area 32, which extends below the gussets 18 and beyond the fold lines 110 and 112.

FIG. 2B is a top perspective view of the partially expanded pillow style bag which has been illustrated filled with popcorn and sealed so as to more clearly illustrate the proximity of the food load 114, susceptor 28, fold lines 110, 112 and gussets 18. The significance of this will be described in more detail below. An adhesive 108 is also preferably provided at the opening 104 thereof in order to provide self-venting.

The microwave food container of this invention, as shown in FIGS. 1 and 2, contains gusseted side panels 18 which allow compact storage and shipment, and expansion of the bag during heating so as to hold popped popcorn. As will be described below, this invention relates to microwave food containers of this general type wherein the printed-on susceptor 28 is arranged so as to provide a substantially uniform temperature across the susceptor in accordance with a quantity of food adjacent to the susceptor during heating of the food. It was found that the heating efficiency of the printed-on susceptor 28 is load-dependent, and accordingly has been modified to prevent charring and burning of the substrate at portions of the bag having a small load. Such portions of the bag typically include the portions under the gussets for bags of the type shown in FIGS. 1A, 1B, 2A and 2B. Additionally, charring and burning is prevented in areas which initially have no food load in proximity thereto, but subsequently have a food load disposed in proximity thereto. Such portions of the bag typically include those extending between fold lines 110, 112 and sealed ends 108, 106, respectively.

As noted above, the susceptor 28 in accordance with the invention has patterns which are adapted to provide substantially uniform temperatures across the substrate during heating. This is in contrast to susceptors of the type described by Maynard et al. and others wherein the pattern of the microwave interactive element is selected to focus the generated heat to predetermined areas of the food, thereby forming heat gradients, and wherein the patterns are tailored to the shape of specific food products. It has been found that substantially uniform temperatures across the susceptor may be achieved by separating the susceptor into sub-patterns so as to eliminate the so-called edge heating effect. In other words, by separating the susceptor pattern up into numerous sub-patterns of a sufficiently small size, temperature gradients across the susceptor are substantially prevented. In addition, by lessening the print coverage of the susceptor where little load is expected during initial heating (such as under the gussets), burning and charring of the substrate on which the susceptor is printed is substantially eliminated using the techniques of this invention.

The susceptor 28 of the invention is preferably created by printing the susceptor ink onto the packaging materials. Such a susceptor ink generally includes dispersed microwave active particles, such as graphite or carbon black particles, in an ink. The susceptor of this invention may be printed by any known printing technique such as flexographic, relief, intaglio, or other printing process. In addition, for metal based inks, prior art metallization and/or polymeric impregnation processes may also be used in order to create the desired susceptor pattern.

The printed-on susceptor of this invention preferably comprises a susceptor ink including microwave active particles suspended in an appropriate vehicle having the viscosity necessary for proper transfer during printing. In a preferred embodiment, the microwave active particles are graphite particles and can be used for moderate heating without compensators of the type used in the prior art. When such a susceptor ink is applied and dried on an appropriate substrate, the microwave active particles will act to absorb microwave energy and convert such energy into heat. In order to assure relatively uniform conversion of microwave energy, the microwave active particles should be generally the same size and be substantially uniformly dispersed in the ink vehicle during printing. This substantially uniform particle size can be any dimension within the range of from preferably 0.5 micron to 50 microns, while microwave active particles having a particle size in the range of from 4–10 microns are preferred. In a particular embodiment of the invention, the microwave active particles are graphite particles such as Micro 270 TM particles manufactured and sold by Asbury Graphite Mills (Asbury, N.J.).

It is also preferred for the susceptor ink to have a solids content, including the microwave active particles, greater than approximately 35% in accordance with the desired viscosity. For example, a solids content of approximately 35% is desirable for gravure printing whereas a solids content of about 50% is better for flexographic printing. An example of a preferred ink formula for flexographic printing in accordance with the present invention is as follows:

32±1% Asbury Graphite Micro 270 TM with 4–6 micron particle size;

17±1% S. E. Johnson Joncryl 678 TM styrene/acrylic resin;

3±0.02% ammonia;

1±0.01% isopropanol; and

47±2% water.

A defoaming agent may also be added as needed.

The printing ink preferably includes a graphite substance suspended in a vehicle with resin, a solvent, a defoaming agent and a drier. Those skilled in the art will appreciate that such an ink composition is primarily adapted for printing on a paper substrate. It will also be appreciated by those skilled in the art that if the printing is to be on a substrate other than paper, such as polyethylene, a modifier is required in order for the microwave active particles to adhere to the substrate. Other inks, such as Unirez TM rosin resin-based graphite inks, may also be used for printing the substrate in accordance with this invention.

When applied to food containers such as those shown in FIGS. 1 and 2, the susceptor 28 is preferably printed on the outside of an inner ply of a two ply substrate, although the susceptor 28 may also be printed on the inside of the outer ply of the two ply substrate. In a preferred embodiment of a microwave popcorn bag, the inner ply is a greaseproof paper such as a 25# greaseproof paper. The outer substrate, on the other hand, may be a 30# machine-glazed kraft paper. A laminating adhesive such as a National Starch Resyn 33-9138 may be preferably used to adhere the outer ply to the inner ply once the susceptor is printed thereon. The top and bottom closures of the bag preferably use a PVAc based adhesive such as Duracet 30 as adhesive 108. More details concerning the manufacturing of a food container in accordance with the invention will be described below.

As noted above, it has been discovered that when susceptors are used in microwave food packages having gussets, such as microwave popcorn bags of the type depicted in FIGS. 1 and 2, heat buildup under the gussets causes scorching and charring of the bag to occur. This problem is solved in accordance with this invention by reducing the susceptor print coverage under the gussets. An example of such a susceptor in accordance with the invention is illustrated in FIGS. 3 and 4.

Figure 3:
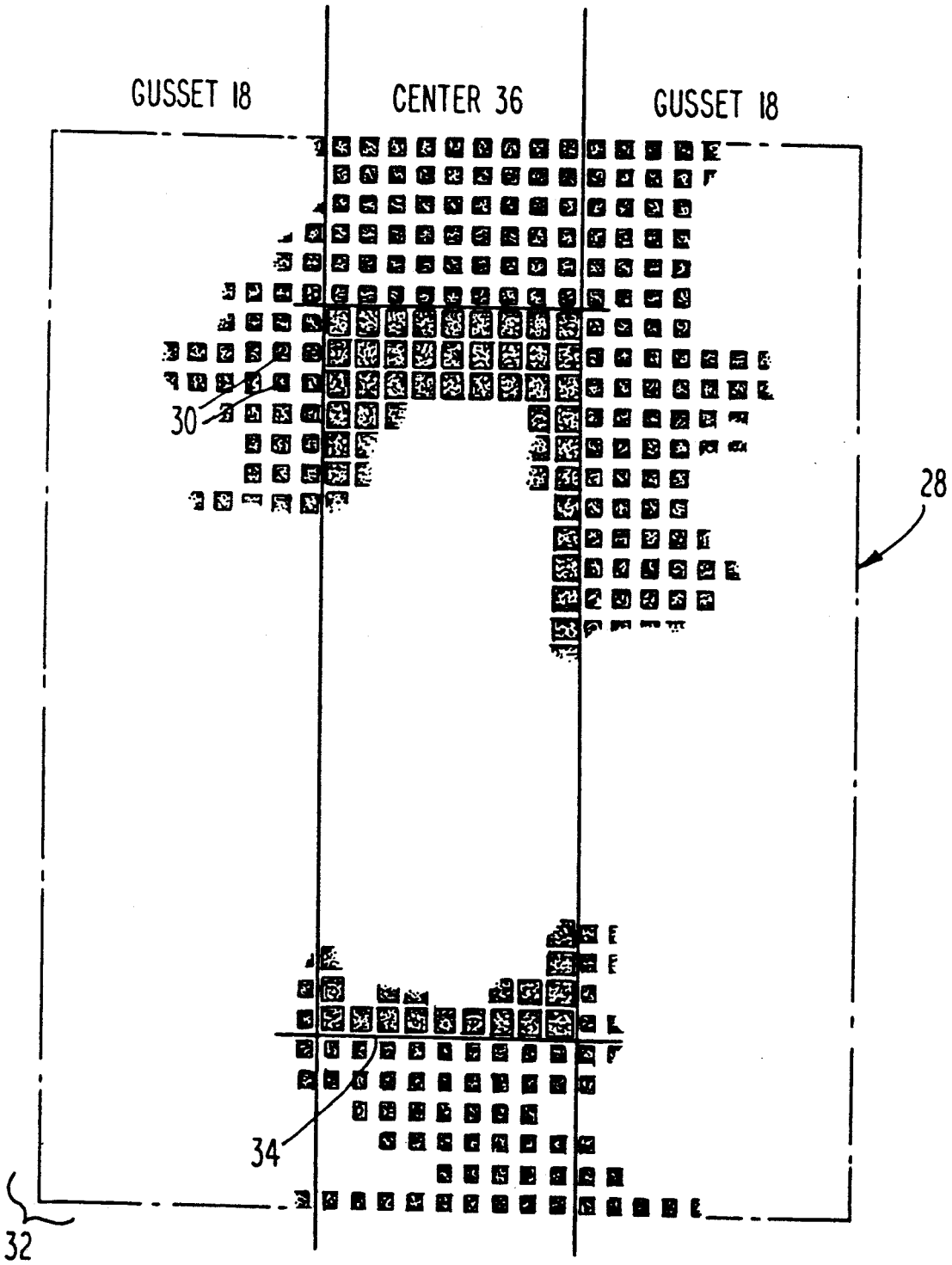
FIG. 3 illustrates a printed susceptor in accordance with a first embodiment of this invention.
Figure 4:
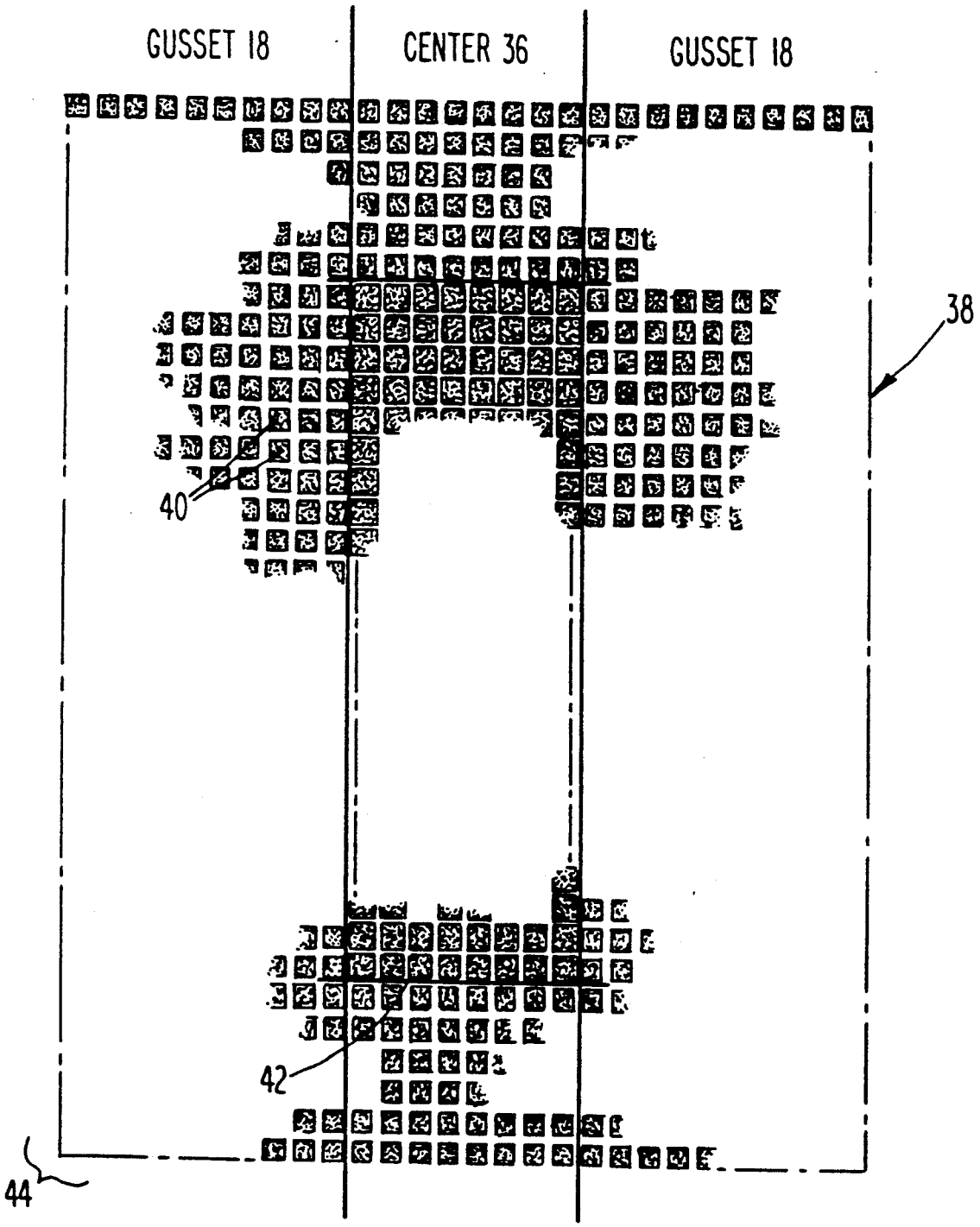
FIG. 4 illustrates a printed susceptor in accordance with a second embodiment of this invention.

The susceptor 28 in the embodiments of FIGS. 3 and 4 has two major components. First, the whole susceptor pattern is broken up into small squares 30, 40 to eliminate the edge heating effect. Second, the second print coverage 32, 44 under the gussets 18 is designed to be lower than the first print coverage 34, 42 located within the center section 36 of the microwave food container. In other words, the print coverage 34 located within the center section 36 of the food container is relatively dense since the food product, e.g. popcorn and oil, is primarily located in this area for heating. A relatively large load is thus present in the portion covered by the first print coverage 34 during heating, and a relatively large print coverage is needed to provide the necessary heat. On the other hand, the load under the gussets 18 is typically lower than in the portion of the microwave food container covered by the first print coverage 34 since less food is typically located under the gussets 18 prior to expansion of the microwave food container. As a result of the lesser load, the print coverage 32 under the gussets is reduced so that less heat is generated for application to the load under the gussets. By so reducing the print coverage 32 of the portion of the susceptor 28 under the gussets, the temperature of the microwave food container may be maintained relatively constant under the gussets 18 as well as in the center section 36. For similar reasons, the print coverage at the ends of the center section 36 of the food container may also be reduced. In fact, it has been found that by adjusting the print coverages under the gussets 18 and at the ends of the center section 36, the temperature across the entire susceptor pattern of the microwave food container may be maintained relatively constant. This is highly desirable since elimination of the temperature gradients substantially prevents charring and burning of the substrate while allowing optimum microwave heating.

In the embodiment of FIG. 3, the susceptor of the invention has a surface area print coverage 34 located within the center section 36 on the order of 78% and an outside surface area print coverage 32 in the portions of the susceptor under the gussets 18 and at the ends of center section 36 on the order of 40%. FIG. 4 shows a similar pattern for a susceptor 38 having sub-patterns 40 with a first surface area print coverage 42 on the order of 78% in the center section 36 of the susceptor 38 and a second surface area print coverage 44 on the order of 60% in the portion of the susceptor 38 under the gussets 18 and at the ends of center section 36. Of course, these print coverages are given only by way of example, and one skilled in the art will appreciate that different print coverages may be used in accordance with the variation in load in the center section 36 and/or under the gussets 18. Moreover, one skilled in the art will appreciate that similar variations relating to the first and second print coverages apply when the print coverage is measured by the thickness of the susceptor or the concentration of the microwave interactive particles in the ink. Preferably, the print coverage 34 in the center section 36 of the susceptor 28 is between 60 and 90%, while the print coverage 32 in the portion of the susceptor 28 under the gussets 18 is between 20 and 80%, although a print coverage 32 between 40 and 60% is preferred. The importance is that the difference between the center section and the outer section be selected to allow for uniform heating. It has been found that optimum results are obtained if the difference is greater than about ten percent (10%) and less than about forty percent (40%).

Those skilled in the art will appreciate that FIGS. 3 and 4 illustrate different surface area print coverages. However, as noted above, the print coverage may be varied by changing the susceptor thickness and/or the concentration of conductive particles in the susceptor ink. Such variations are left to the discretion of those skilled in the art.

Figure 5:
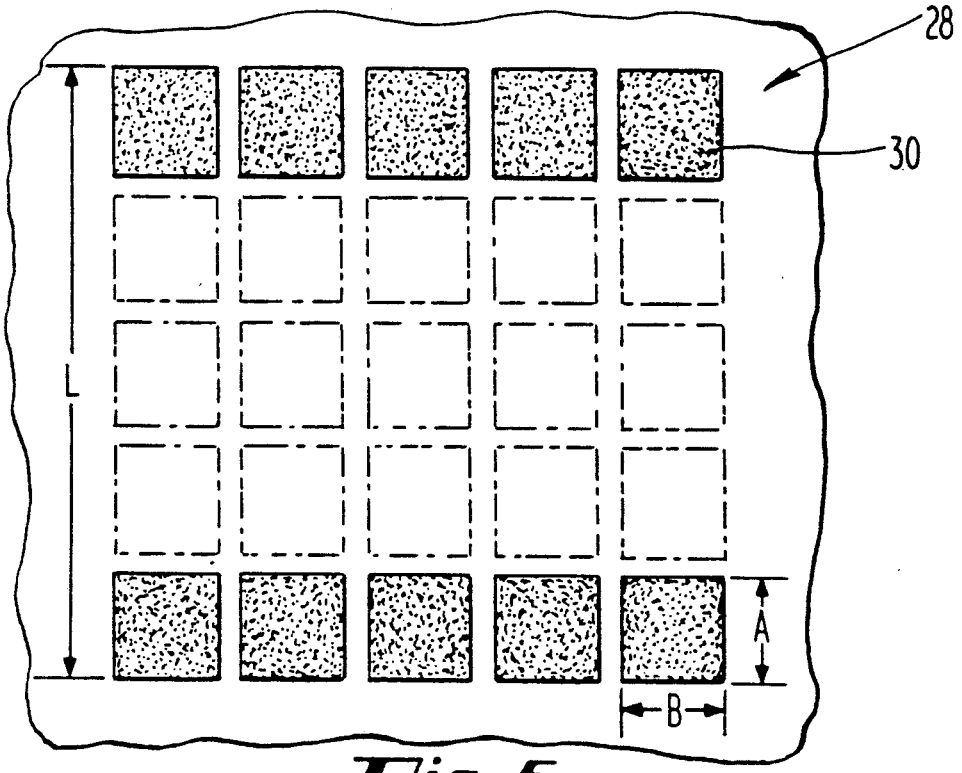
FIG. 5 illustrates an enlarged view of a portion of the susceptors illustrated in FIGS. 3 and 4.

A susceptor printed in accordance with the present invention is shown in more detail in FIG. 5. As shown, the susceptor 28 comprises sub-patterns 30 printed on a substrate which is preferably either the outer surface of the inner ply or the inner surface of the outer ply of a 2-ply gusseted microwave popcorn bag of the type shown in FIGS. 1 and 2. In a preferred embodiment, the substrate is a laminated paper such a 25# greaseproof paper that is laminated to a layer of 30# machine glazed paper.

In FIG. 5, sub-patterns 30 are illustrated as squares with dimensions A and B (A=B) arranged to form a susceptor with an overall per side length L. It is preferred that the length A and width B of the sub-patterns 30 be such that these dimensions are less than or equal to $\lambda/4$, or $\frac{1}{4}$ of the wavelength of the microwave to which the susceptor is subjected. Since the typical wavelength of microwaves in commercially available microwave ovens is approximately 12 cm, dimensions A and B are preferably no larger than approximately 3 cm. In the embodiments of FIGS. 3 and 4, for example, the sub-patterns are preferably 0.156 $in^2$ blocks in the portion covered by the first print coverage 34 located within the center sections 36, 0.109 $in^2$ blocks under gussets 18 and in the end portions of center section 36 in the embodiment of FIG. 3 and 0.135 $in^2$ blocks under gussets 18 and in the end portions of center section 36 in the embodiment of FIG. 4.

Figure 6:
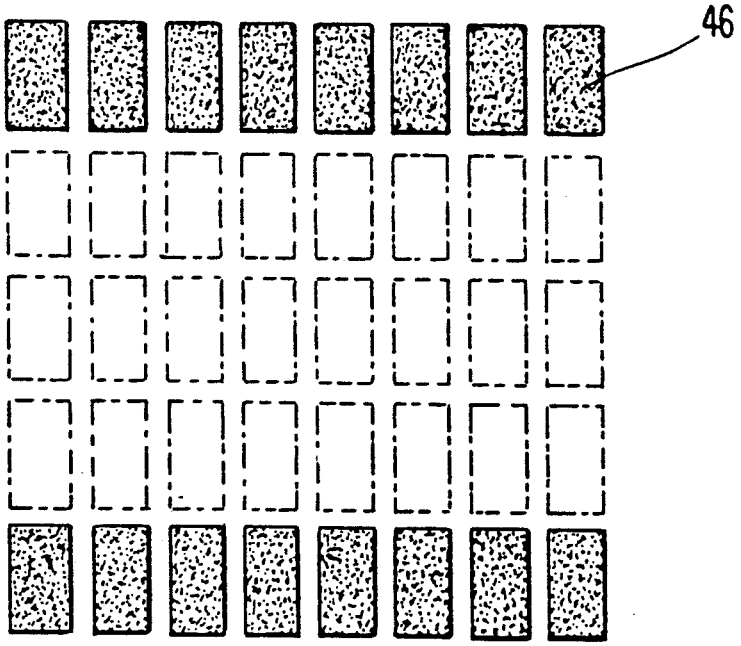
FIGS. 6–8 are illustrations of alternative susceptor patterns suitable for use in this invention.
Figure 7:
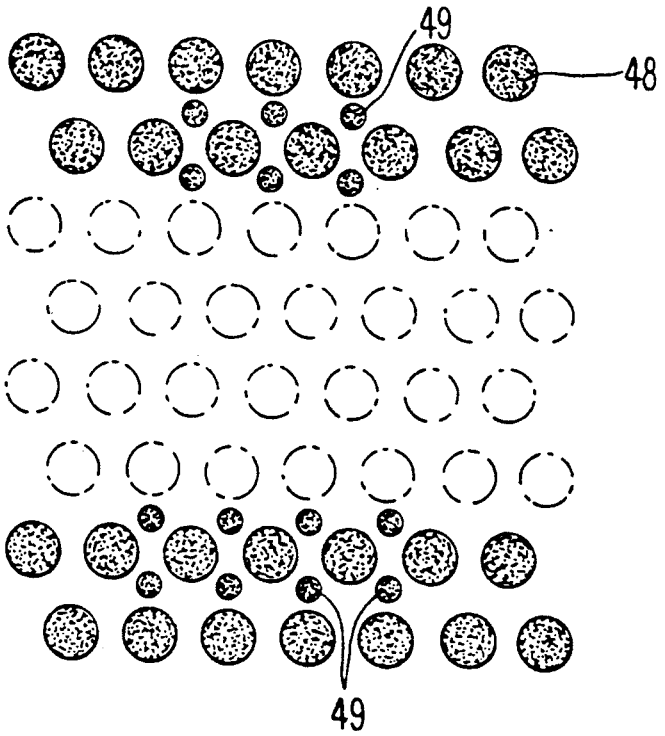
Figure 8:
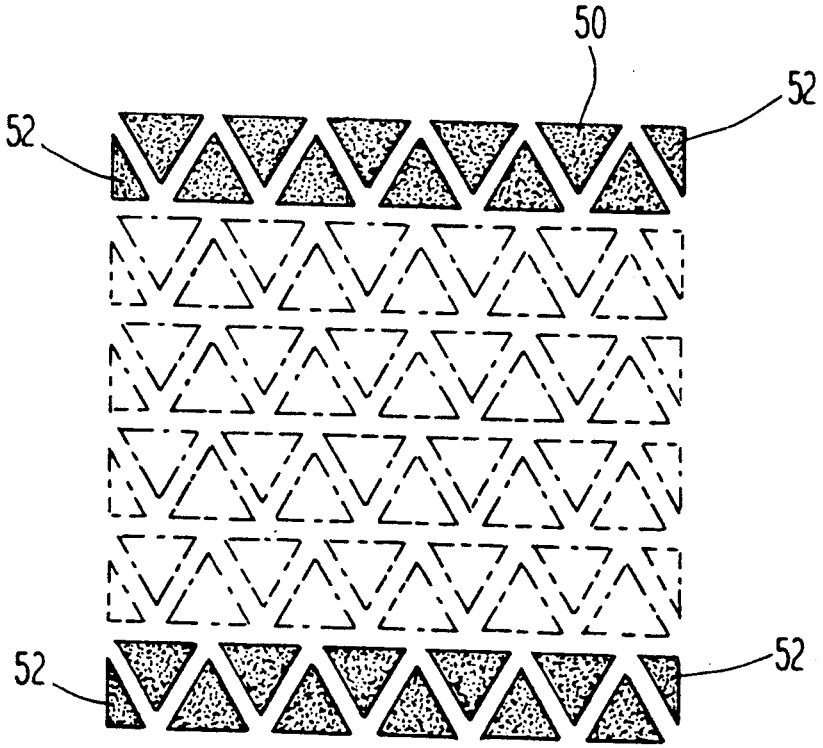

The sub-patterns 30, 40 of the embodiments of FIGS. 3 and 4 need not be limited to squares. For example, as shown in FIG. 6, squares may be replaced by rectangles 46 in which A>B. Similarly, as shown in FIG. 7, the susceptor 28 may comprise a plurality of circles 48 which are offset from adjacent rows. Interstitial circles 49 may be used in such an embodiment in the center portion of the susceptor to increase the surface area print coverage in accordance with the invention. In addition, as shown in FIG. 8, susceptor 28 may comprise a plurality of equilateral triangles 50 and a plurality of right triangles 52 at the end of each row, wherein the length of the hypotenuse of each right triangle 52 is substantially equal to the side of an adjacent triangle 50. Of course, many other patterns are possible in accordance with the invention. However, in order to achieve the beneficial results of the invention, all such patterns should have reduced print coverages in the section of the microwave food container under the gussets in order to maintain relatively constant temperature during heating in the portion of the food container containing the susceptor.

EXAMPLES

Prior to manufacture of a microwave popcorn bag as a microwave food package in accordance with the invention, the microwave interactive ink composition is first prepared. The ink composition is prepared in two stages, namely, the ink carrier or vehicle is prepared and then the desired amount of pigment is added to the vehicle and diluted with water to obtain the desired viscosity. As noted above, the preferred ink composition of the invention comprises 32±1% of Asbury Graphite Micro 270 TM with a 4–6 micron particle size, 17±1% of S. C. Johnson Joncryl 678 TM styrene/acrylic resin, 3±0.02% ammonia, 1±0.01% anhydrous isopropanol and 47±2% water. Generally, the ink vehicle is first prepared by mixing in a blender for 30 minutes the styrene/acrylic resin, the ammonia, the anhydrous isopropanol and the water. Of course, other ink vehicles may be used in accordance with the invention, such as those based on starch, casein and other proteins, rosin copolymers, resinates, and the like. The ink composition is then obtained by adding the graphite pigment to the ink vehicle and then adding water to dilute the ink to the desired viscosity. A viscosity of between 20 and 40 seconds as measured in a #3 Zahn cup is typical for flexographic inks, but such value should not be viewed as limiting. Moreover, different solids contents are possible for different types of printing as described above.

Once the ink composition has been prepared, the microwave popcorn bag may be prepared by obtaining a greaseproof inner ply such as a 25# greaseproof paper. The outer ply may be a 30# machine-glazed paper. The bag graphics such as brand, directions and the like are then printed onto the outside of the outer ply using any known technique. A laminating adhesive such as National Starch Resyn 33-9138 is also applied to the inside of the outer ply.

The ink composition is then preferably applied to the outside portion of the greaseproof inner ply at the desired coating thickness, although one skilled in the art will recognize that the susceptor may be applied on the inside portion of the outer ply. As noted above, the coating thickness or graphite particle concentration may be varied in order to get the reduced print coverage under the gussets; however, for the reduced surface area susceptor pattern shown in FIGS. 3 and 4, the coating thickness should be substantially even. On the other hand, a combination of these techniques is also possible. In a preferred embodiment, the ink composition of the invention is designed for use in a flexographic printing apparatus, although it is noted that other forms of printing instead may be used, such as rotogravure, lithograph, or letter press. The optimum ink viscosity for the preferred flexographic printing process is known to be from 20 to 40 seconds (#3 Zahn). However, other printing processes have different viscosity requirements, and accordingly, the above-mentioned viscosity range should not be taken as a limiting value.

In a flexographic printing operation, the ink is metered onto an anilox roll engraved with a network of cells with a defined size and depth, which defines the coating weight of the ink layer. This volume is then transferred onto a photopolymer plate on an application roll, which in turn applies the ink to the paper sheet. As noted above, the ink need not be applied to the surface of the substrate which contacts the food; therefore, no FDA approved coating for the susceptor is necessary. In accordance with the invention, the ink is applied in a pattern having reduced print coverage under the gussets as shown in FIGS. 3 and 4. Of course, any of the patterns shown in FIGS. 5–8 also may be used so long as the coverage under the gussets is reduced compared to that in the center of the ply. Moreover, although the printing and laminating steps are preferably performed on the same machine, this need not be the case.

The microwave popcorn bag is then formed by first laminating the outer and inner plys with the susceptor sandwiched therebetween using a rolling nip laminator operating at the necessary speed. A closure adhesive such as 4#/3MSF of Duracet 30, which is a PVAc based heat seal adhesive, is then applied to proper portions of the inside of the greaseproof paper. The resulting rollstock is then dried and rolled up. The rollstock may then be transferred to a bag machine for conversion into bags with an opening for insertion of food or can be formed, filled with food and sealed on an appropriately designed packaging machine. For example, the resulting bag may be a two-ply self-opening style (FIG. 1) or a two-ply pillow style (FIG. 2) microwave popcorn bag.

Figure 9:
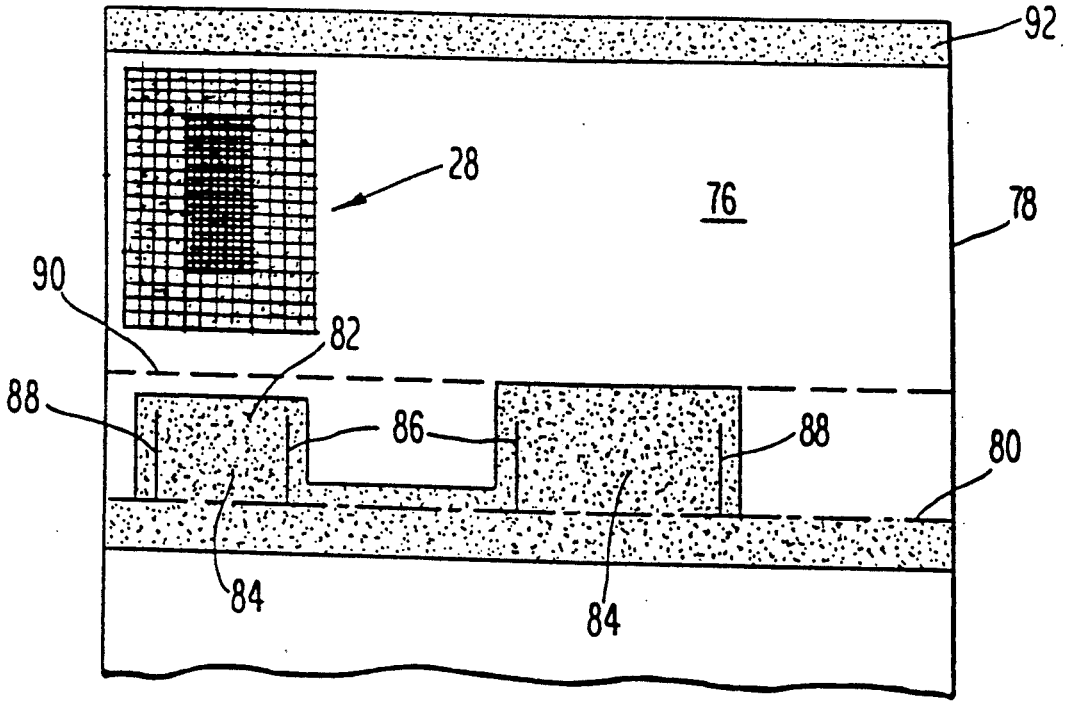
FIG. 9 is a plan view of a portion of a paper web during manufacture onto which a susceptor has been printed in accordance with this invention.

FIG. 9 illustrates a sheet 76 which may be formed into a microwave popcorn bag or similar food package in accordance with the invention. Sheet 76 is part of a continuous web 78 from Which numerous bags are to be manufactured. In order to form individual bags, sheet 76 is cut along line 80 in any known manner. A preselected pattern of adhesive coating 82 is pre-applied to the inside surface of sheet 76 by any known method as described above. Such coating of adhesive 82 covers tongues 84 and respectively extends laterally beyond slits 86 and 88 and longitudinally towards line 90. A further strip of adhesive may also be deposited along cut line 92 as illustrated. Although not shown, it will also be appreciated that a strip of adhesive will be deposited along one of the side edges of web 78 so that the side edges can be joined in the bag forming operation. A susceptor 28 in accordance with the invention is preferably printed on sheet 76 between the inner and outer plies as previously described.

Figure 10:
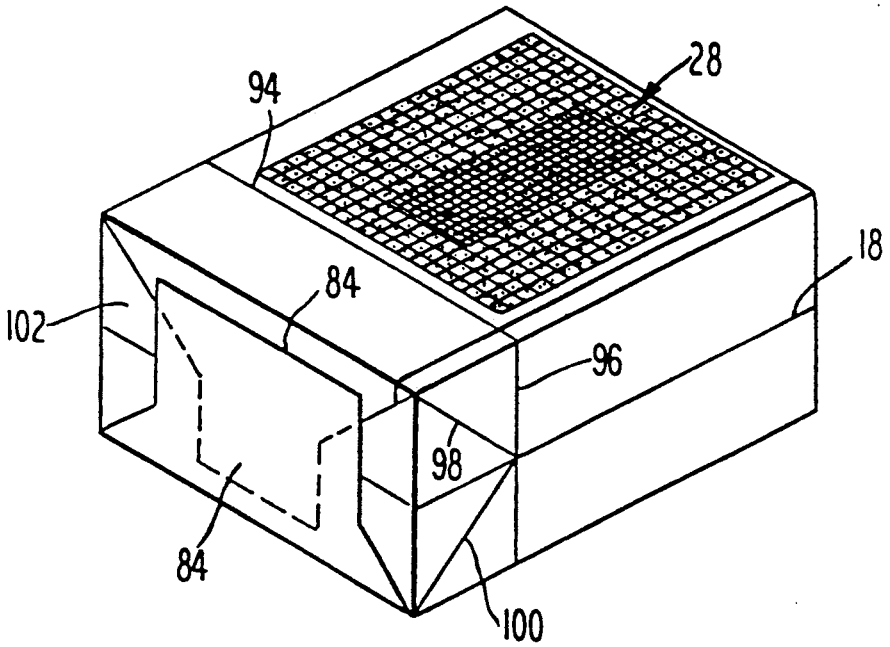
FIG. 10 is a perspective view of a bag formed from the paper web shown in FIG. 9.

The resulting sheet 76 can then be formed into a pillow style bag as shown in FIG. 2 or a self-opening style bag as shown in FIG. 1. The bag of FIG. 1 is shown fully opened in FIG. 10. To achieve the indicated shape upon inflation, centrally folding or off-centered gussets 18 are formed in the side walls of the bag. Transfer fold lines 94 and 96 and diagonal fold lines 98 and 100 are formed in any known manner. Although not shown, it will be appreciated by those skilled in the art that fold lines similar to lines 96, 98 and 100 are also formed in the side of the bag in which the side flap 102 is formed. Typically, the manufacture of such bags involves first forming sheet 76 into a tube by joining its side edges. The tube is thereafter flattened along inwardly folding gussets 18 and thereafter manipulated in such flattened form. After folding inside flaps and folding over tongues 84, the bag is sealed through the application of heat and pressure in any known manner. The result is a self-venting style bag having a susceptor 28 printed on an outer surface of the inner ply or on an inner surface of the outer ply as shown in FIG. 10.

As noted above, the desired print coverage may be tailored in accordance with the shape of the microwave food package by varying the surface area covered or the thickness of the ink coating on the substrate. Similarly, the concentration of the microwave conductive material may be varied to achieve the desired effect.

COMPARATIVE EXAMPLE

Figure 11:
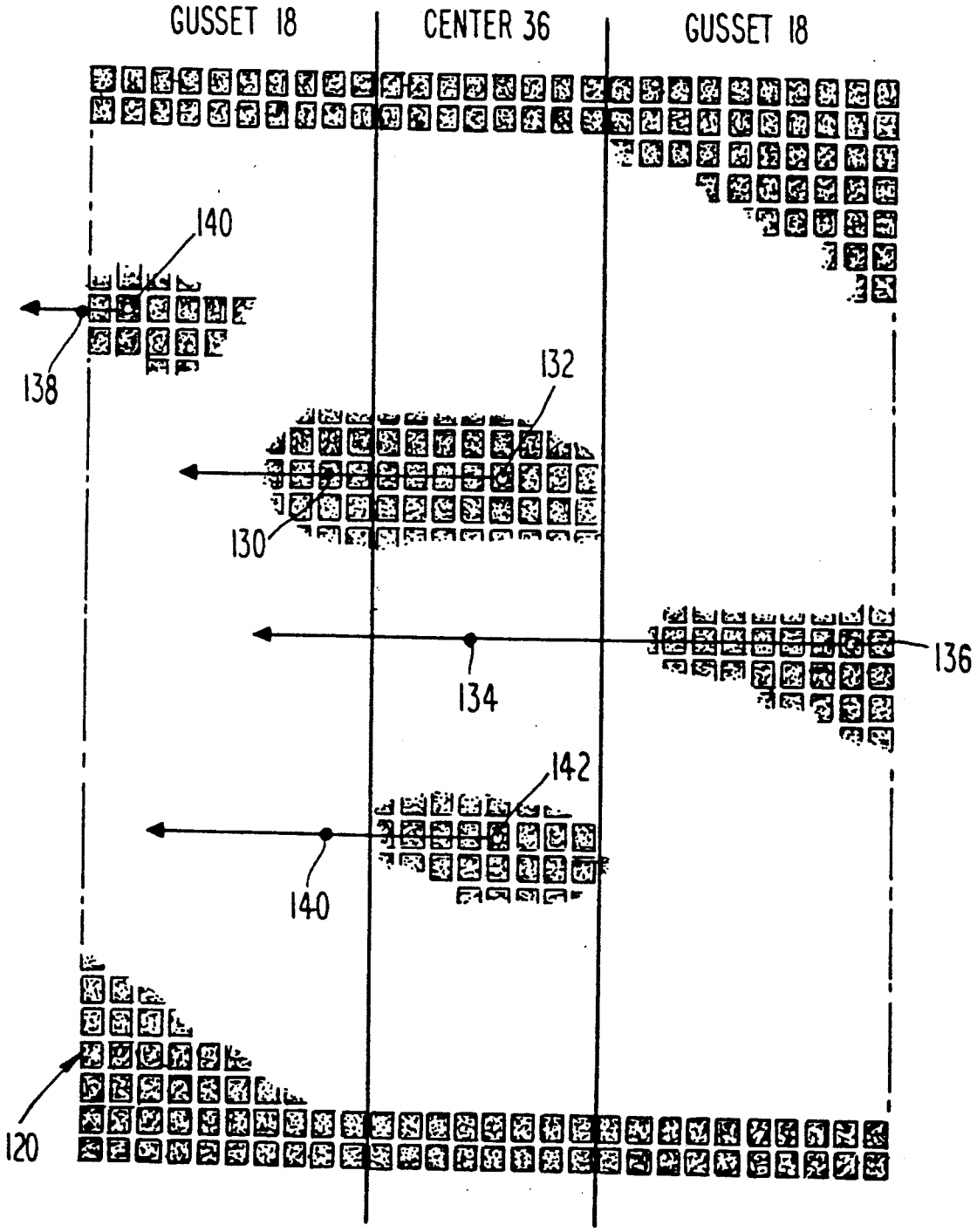
FIG. 11 illustrates a control pattern and the location of respective probes used for measuring temperature variations during heating in a microwave oven.

A microwave popcorn bag having a susceptor pattern as shown in FIG. 3 was prepared using the above procedure. A control microwave popcorn bag having a susceptor pattern 120 without reduced print coverage under the gussets as shown in FIG. 11 was also prepared using the above procedure. Each popcorn bag was then punctured in four areas and Luxtron TM MIW-2 temperature probes interfaced with a Luxtronx TM Model 755 Fluoroptic Temperature Sensor were inserted into the holes. Since the temperature is measured only at the probe tip, the probes were placed so that their tips were in contact with the areas marked in FIG. 11. In particular, a first probe was inserted through hole 140 such that its tip resided at 142; a second probe was inserted through hole 130 such that its tip resided at 132; a third probe was inserted through hole 134 such that its tip resided at 136; and a fourth probe was inserted through hole 138 such that its tip resided at 140. The probe tips and the holes were then completely covered with Kapton TM heat resistant tape. The tip locations noted in FIG. 11 were specifically chosen so that two tips were located under the gussets 18 and two tips were centrally located in center section 36 for comparison purposes.

The bags were then filled with 77.00 grams of popcorn and with 24.0 ml of partially hydrogenated soybean oil. The bags were then sealed using a flat iron as a heat-seal device. The bags and their contents were then microwaved in a Panasonic NN-7707 700 watt microwave oven (calibrated to 690±5 watts) for a total of 5 minutes. The temperature of the four probes was monitored and data was collected by an IBM PC-Clone computer. Each test was performed three times, resulting in six temperature runs for each position (central or gusset). The resulting temperature readings can be seen in FIG. 12.

Figure 12:
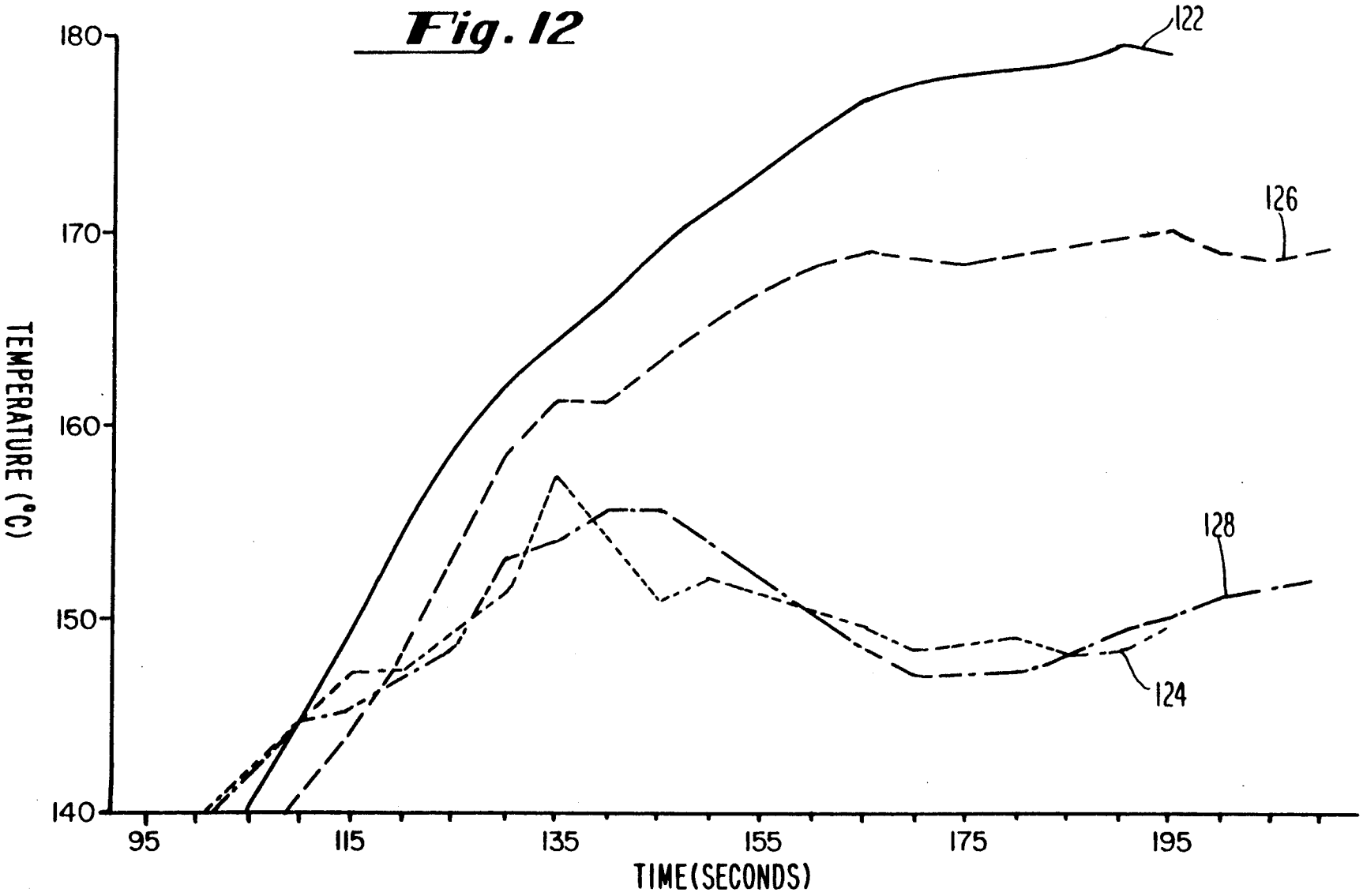
FIG. 12 illustrates temperature variations for susceptor patterns in accordance with the invention compared with temperature variations for the control pattern of FIG. 11 during heating.

FIG. 12 illustrates that the temperature rise under the gussets of the control pattern (curve 122) far exceeds the temperature rise in the center of the control pattern (curve 124). In fact, two runs had to be discontinued when the temperature of the control susceptor reached more than 260° C. under the gussets, thereby putting the fluoroptic probes in danger.

For the microwave popcorn bag having the susceptor pattern with reduced print coverage under the gussets, however, the temperature rise under the gussets (curve 126) and in the center (curve 128) are more nearly the same. Thus, FIG. 12 illustrates that the temperature of the printed susceptor is load-dependent and, hence, that a more uniform temperature across the susceptor may be obtained by reducing the print coverage under the gussets in accordance with the reduced load under the gussets. Also, by reducing the coverage underneath the gussets, the present invention provides better control over runaway heating without the required use of thermocompensators and the like as used in the prior art.

The printed susceptor patterns of the invention, whereby the print coverage under the gussets is reduced, thus substantially prevent burning and charring of the microwave food container and allow for better control of the microwave heating. Moreover, temperature of the food heated in the microwave food package in accordance with the invention may be kept more constant by recognizing that the heating by the susceptor is load-dependent and accordingly modifying the print coverage of the susceptor in accordance with the quantity of food to be heated at a particular location of the food package. Of course, for expandable, flexible gusseted microwave food packages, little food may be found under the gussets until the package is completely inflated. Thus, the present invention is particularly useful in such packages.

Although the exemplary embodiments of the invention have been described in detail above, those skilled in the art will readily appreciate that many additional modifications are possible in the exemplary embodiments without materially departing from the novel teachings and advantages of the invention. For example, metal-based inks may be used in place of the graphite ink of the preferred embodiment. However, since metal inks crack when placed under a severe load, adversely affecting their heating efficiency, graphite inks are presently preferred for moderate heating without thermocompensators. Of course, for more intense heating, thermocompensators may be used.

In addition, a further embodiment of the susceptor of the invention may have a graduated print coverage which declines from the center of the susceptor pattern toward the outward edges under the gussets. On the other hand, the print coverage in the center of the susceptor may be uniform while the print coverage under the gussets is graduated toward the outward edges of the package. In another embodiment, the print coverage in the center of the food container (not under the gussets) may be uniform throughout. For example, in the embodiments of FIGS. 3 and 4, the center portions 34 and 42 may extend to the ends of the container. However, care must be taken in such designs to make certain that the container does not burn or char at the ends due to a reduced load. Accordingly, all such modifications are intended to be included within the scope of this invention as defined in the following claims.

What is claimed is:

1. A microwave package comprised of first and second opposing wall members, first and second gusseted side wall members connecting opposing edges of the first and second wall members, said first and second gusseted side wall members in a non-expanded state extending towards each other between the first and second wall members, with the opposing edges of the side wall members being spaced apart a pre-determined distance to provide a central portion in the package which does not include said gusseted side wall members; a printed-on susceptor formed on one of said first or second wall members, having a first area of microwave activity in the central portion and a second and lower area of microwave activity under the gusseted side wall, wherein the first microwave activity and the second microwave activity are selected to provide substantially uniform microwave heating across the susceptor of a product initially positioned primarily in the central area of the microwave package.

2. The microwave package according to claim 1, wherein the first area of microwave activity consists of sub-patterns of discrete printed elements of a size to substantially eliminate edge heating of the elements and being applied in a print coverage of up to 90% of the central portion, and said second area being provided with sub-patterns of discrete elements of a size to substantially eliminate edge heating and being applied in a print coverage of up to 80%, with the relative difference between the print coverage between the first area of microwave activity and the second area of microwave activity being at least about 10% and less than about 40%.

3. The microwave package according to claim 1, wherein the walls of the package are comprised of a greaseproof paper on the inner side of the package and a layer of a second type of paper on the outer surface of the package.

4. The microwave package according to claim 3, wherein the susceptor is printed on either the greaseproof layer or the second layer of paper and is positioned between the greaseproof layer and the second layer of paper.

5. A microwave food package with gussets on opposite sides thereof and an opening for the introduction of food to be heated in a microwave oven, comprising:

a greaseproof inner substrate for holding said food;

an outer substrate surrounding and adhesively attached to said inner substrate; and a printed-on susceptor comprising a coating of a microwave reactive composition printed on either an inner surface of said outer substrate or the outer surface of said inner substrate in a pattern having a first print coverage in a center portion of said microwave food package and a second print coverage, less than said first print coverage, under said gussets so as to provide substantially uniform microwave heating across the susceptor and to substantially prevent charring of said inner and outer substrates under said gussets during heating of said food.

6. A microwave food package according to claim 5, wherein said food is popcorn and oil, and the food is primarily located in said center portion during heating and said inner and outer substrates are formed into a flexible, expandable microwave popcorn bag for holding popped popcorn and oil upon heating.

7. A microwave food package according to claim 5, wherein said pattern comprises sub-patterns in a spaced relationship adapted to maintain a substantially uniform temperature across said pattern so as to substantially prevent charring of said inner and outer substrates during heating of said food.

8. A microwave food package according to claim 7, wherein sub-patterns in said center portion cover a percentage of the surface area of said center portion determined by said first print coverage and sub-patterns under said gussets cover a percentage of the surface area under said gussets determined by said second print coverage.

9. A microwave food package according to claim 7, wherein sub-patterns in said center portion have a print thickness in said center portion determined by said first print coverage and sub-patterns under said gussets have a print thickness under said gussets determined by said second print coverage.

10. A microwave food package according to claim 7, wherein sub-patterns in said center portion have a concentration of microwave reactive particles of said microwave reactive composition in said center portion determined by said first print coverage and sub-patterns under said gussets have a concentration of microwave reactive particles of said microwave reactive composition under said gussets determined by said second print coverage.

11. A microwave food package according to claim 7, wherein each of said sub-patterns comprises at least one of a square, a rectangle, a circle and a triangle.

12. A microwave food package according to claim 5, wherein said first print coverage is in a range of approximately 60% to 90% of the surface area of said center portion and said second print coverage is in a range of approximately 20% to 80% of the surface area of a portion of said microwave food package under said gussets and covered by said pattern.

13. A microwave food package according to claim 12, wherein said second print coverage is in a range of approximately 40% to 60% of the surface area of a portion of said microwave food package under said gussets and covered by said pattern.

14. A microwave food package according to claim 5, wherein said microwave reactive composition comprises a graphite based ink.

15. A microwave food package according to claim 5, wherein said microwave reactive composition comprises a metal based ink.

16. A microwave food package according to claim 5, wherein said microwave reactive composition comprises an ink having carbon black containing particles.

17. A microwave food package according to claim 5, wherein said second print coverage decreases in graduated steps from said center portion to an outer edge of said package under said gussets.

18. A microwave food package according to claim 5, wherein end portions of said package are covered by a portion of said pattern having said second print coverage.

19. A microwave food package with gussets on opposite sides thereof and an opening for the introduction of food to be heated in a microwave oven, comprising:

a greaseproof inner substrate for holding said food;

an outer substrate surrounding and adhesively attached to said inner substrate; and a printed heating element comprising a coating of a microwave reactive composition printed on either an inner surface of said outer substrate or an outer surface of said inner substrate in a pattern having a first microwave activity in a center portion of said microwave food package and a second microwave activity, less than said first microwave activity, under said gussets, said first and second microwave activities being selected so as to provide a substantially uniform temperature across said pattern during microwave heating of said food.

20. A microwave food package according to claim 19, wherein said food is popcorn and oil primarily located in said center portion during heating and said inner and outer substrates are formed into a flexible, expandable microwave popcorn bag for holding popped popcorn and oil during heating.

21. An expandable microwave popcorn bag with gussets on opposite sides thereof and an opening for the introduction of popcorn and oil into said bag for heating in a microwave oven, comprising:

a greaseproof inner substrate for holding said popcorn and oil;

an outer substrate surrounding and adhesively attached to said inner substrate; and a susceptor comprising a coating of a microwave reactive composition printed on either an inner surface of said outer substrate or an outer surface of said inner substrate in a pattern having a first microwave activity in a center portion of said microwave food package and a second microwave activity, less than said first microwave activity, under said gussets so as to provide substantially uniform microwave heating across the susceptor and to substantially prevent charring of said inner and outer substrates under said gussets during heating of said popcorn and oil.

22. A microwave popcorn bag according to claim 21, wherein said pattern comprises sub-patterns in a spaced relationship adapted to maintain a substantially uniform temperature across said pattern so as to substantially prevent charring of said inner and outer substrates during heating of said popcorn and oil.

23. A microwave popcorn bag according to claim 22, wherein sub-patterns in said center portion cover a percentage of the surface area of said center portion determined by said first microwave activity and sub-patterns under said gussets cover a percentage of the surface area under said gussets determined by said second microwave activity.

24. A microwave popcorn bag according to claim 22, wherein sub-patterns in said center portion have a print thickness in said center portion determined by said first microwave activity and sub-patterns under said gussets have a print thickness under said gussets determined by said second microwave activity.

25. A microwave popcorn bag according to claim 22, wherein sub-patterns in said center portion have a concentration of microwave reactive particles of said microwave reactive composition in said center portion determined by said first microwave activity and sub-patterns under said gussets have a concentration of microwave reactive particles of said microwave reactive composition under said gussets determined by said second microwave activity.

26. A microwave popcorn bag according to claim 22, wherein each of said sub-patterns comprises at least one of a square, a rectangle, a circle and a triangle.

27. A microwave popcorn bag according to claim 21, wherein said first print coverage is in a range of approximately 60% to 90% of the surface area of said center portion and said second print coverage is in a range of approximately 20% to 80% of the surface area of a portion of said microwave food package under said gussets and covered by said pattern.

28. A microwave popcorn bag according to claim 27, wherein said second print coverage is in a range of approximately 40% to 60% of the surface area of a portion of said microwave food package under said gussets and covered by said pattern.

29. A microwave popcorn bag according to claim 21, wherein said microwave reactive composition comprises a graphite based ink.

30. A microwave popcorn bag according to claim 21, wherein said microwave reactive composition comprises a metal based ink.

31. A microwave popcorn bag according to claim 21, wherein said microwave reactive composition comprises an ink having carbon black containing particles.

32. A microwave popcorn bag according to claim 21, wherein said second print coverage decreases in graduated steps from said center portion to an outer edge of said package under said gussets.

33. A microwave popcorn bag according to claim 21, wherein end portions of said bag are covered by a portion of said pattern having said second print coverage.

34. A method of manufacturing a microwave food package with gussets on opposite sides thereof and an opening for the introduction of food to be heated in a microwave oven, comprising the steps of:

providing a greaseproof inner substrate and an outer substrate;

printing onto one of an inner surface of said outer substrate and an outer surface of said inner substrate a heating element comprising a coating of a microwave reactive composition in a pattern having a first print coverage in a center portion of said microwave food package and a second print coverage, less than said first print coverage, under said gussets, said first and second print coverages being selected so as to provide substantially uniform microwave heating across the pattern and to substantially prevent charring of said inner and outer substrates under said gussets during heating of said food;

laminating said inner surface of said outer substrate to said outer surface of said inner substrate with said heating element sandwiched therebetween; and shaping said laminated substrates into said microwave food package with said gussets and said opening for the introduction of food.

* * * * *